US005592141A

United States Patent [19]

Castellano Aldave

[11] Patent Number: 5,592,141

[45] Date of Patent: Jan. 7, 1997

[54] MINIATURE POTENTIOMETER

[75] Inventor: Jesus C. Castellano Aldave, Fontellas, Spain

[73] Assignee: Navarra de Componentes Electronicos, S.A., Tudela, Spain

[21] Appl. No.: 227,525

[22] Filed: Apr. 14, 1994

[30] Foreign Application Priority Data

Apr. 14, 1993 [ES] Spain ..... 9300760

[51] Int. Cl.[6] ..... H01C 10/32

[52] U.S. Cl. ..... 338/162; 338/127; 338/202

[58] Field of Search ..... 338/118, 125, 338/127, 160, 162–163, 166–167, 170, 174, 202, 223, 225 D

[56] References Cited

U.S. PATENT DOCUMENTS

| | | | |
|---|---|---|---|
| 2,706,760 | 4/1955 | Mucher | 338/174 |
| 2,958,839 | 11/1960 | Barden | 338/174 |
| 2,974,299 | 3/1961 | Youngbeck et al. | 338/163 |
| 3,631,372 | 12/1971 | Yamamura | 338/202 |
| 4,429,297 | 1/1984 | Nakatsu | 338/162 |
| 4,482,883 | 11/1984 | Heredero | 338/163 |
| 4,835,511 | 5/1989 | Henmi | 338/174 |
| 4,951,378 | 8/1990 | Arriazu | 29/593 |
| 5,059,940 | 10/1991 | Thomas, Jr. | 338/174 |

FOREIGN PATENT DOCUMENTS

| | | |
|---|---|---|
| 0348729A2 | 6/1989 | European Pat. Off. . |
| 3735912 | 10/1987 | Germany . |
| 4017225 | 5/1990 | Germany . |
| 462632 | 9/1977 | Spain . |
| 1367839 | 9/1974 | United Kingdom . |
| 2157502 | 3/1985 | United Kingdom . |
| 2220798 | 7/1989 | United Kingdom . |

*Primary Examiner*—Philip H. Leung
*Assistant Examiner*—Raphael Valencia
*Attorney, Agent, or Firm*—Jacobson, Price, Holman & Stern, PLLC

[57] ABSTRACT

A miniature potentiometer including a casing (10) molded on a first sub-assembly comprising a support (11), an electro-resistive track (12) with extensions (13) linked to terminals (14),(15) extending outwardly from the casing, and a collector plate (16) having a collector plate terminal (14) extending outwardly therefrom. A second sub-assembly is housed in the casing (10) and includes a wiper (18) integral with a wiper-holder (19). The first and second sub-assemblies are attached to one another by an electrically conductive shaft (21).

The wiper (18) comprises a first part defined by an annular plate (29) to which the wiper-holder (19) is molded. The first part also includes an opening (31) and through-holes (32) which allow plastic material to flow therethrough. The wiper (18) further comprises a second part (33), extending radially out from the annular plate (29) and having resilient arms (35,36) with protuberances (35a,36a) for frictionally engaging the resistive track (12). The second part (33) is folded 180 degrees against the bottom of the wiper-holder (19) and further comprises a slight cross fold (33a) in opposite sense to the 180 degree fold.

Prior to molding of the casing (10), the extensions (13) are connected to the pair of terminals (14),(15) using two folded lateral appendages (14b, 14c, 15b, 15c) extending from the lateral sides of each terminal (14),(15), one appendage (14b),(15b) from each terminal being in contact with the track (12) while the other appendage (14c),(15c) from each terminal provides retention.

6 Claims, 5 Drawing Sheets

MINIATURE POTENTIOMETER

BACKGROUND OF THE INVENTION

This invention relates to a miniature potentiometer and a process for manufacturing the miniature potentiometer.

The following patents are exemplary of prior art potentiometers and manufacturing processes:

British Patent Specification No. 1,367,839 to Bourns, Inc. discloses a process comprising the steps of:

advancing a continuous metallic laminar band hauled by a longitudinal conveying line with step-by-step forward movement, in which terminals are initially shaped using dies, and further molding a housing body member about portions of the terminal members in respective unit lengths of the strip while leaving resilient contact portions of some contact fingers and end portions of the terminal members protruding from the body member and integral with the strip;

producing rotors with conductive and resistive members thereon, and producing housing cover members; and assembling a rotor and a cover member to respective body members and severing the resulting potentiometers from the strip by shearing the terminal members adjacent the strip.

U.S. Pat. No. 2,958,839 to Barden discloses a potentiometer embodying a resistor in the form of an incomplete arcuate member with two low resistance end extensions connected through stapling to two connection terminals, which extend outwardly from the casing, the potentiometer having a rotation limiting stop integral with the driving shaft;

U.S. Pat. No. 4,951,378 discloses a process for producing potentiometers comprising the steps of:

forming a first fixed subassembly including a casing, a resistant track, and terminals, in the form of a first continuous metallic laminar band, hauled by a longitudinal conveying line, with a step-by-step forward movement, in which the terminals are initially shaped using dies and are attached to the casing through stapling (fold of the connection terminal ends);

configuring a second movable sub-assembly including a wiper, a wiper-holder and a collector, the mechanical connection of these elements to one another being performed by thermoforming, on a second step-by-step advancing continuous band;

coupling both subassemblies so as to define a third continuous step-by-step advancing band, and mechanically and electrically checking potentiometers connected to the third continuous band.

Spanish Patent No. 462,632 discloses in FIG. 17 a piece in the form of a tubular shaft constituting a wiper and an attachment member for two subassemblies:

a first one including an arcuate resistor supported on an insulating plate, with two extensions of electrically conductive material linked to a pair of connecting terminals, and a second one substantially including a collector plate.

The piece is obtained from a metallic plate using dies, and comprises an extension connected to a bottom of the tubular shaft. The extension terminates in an annular portion which is folded against the bottom of the shaft. A crown-shaped part is provided and includes a driver engaging cross grooves formed therein. These cross grooves permit rotation of the wiper using a screwdriver.

SUMMARY OF THE INVENTION

A primary object of the present invention is to provide a potentiometer according to the general structure described above and to carry out a process of manufacture which essentially provides:

a) a reduction in the production cost by simplifying the above operations, namely:

using a same casing for the horizontal or vertical mounting potentiometers;

firmly securing the resistant track to the connection terminals before the casing is molded;

b) increasing performance of the potentiometers by providing:

optimal elastic and anchoring performance of the wiper attached to the wiper-holder using a molding operation and some shaping operations;

greater strength in a movable stop of the tubular shaft as well as the use of a reinforcement via a double wall.

To achieve these and other objects, the miniature potentiometer of the present invention comprises:

a) an insulating vessel-shaped casing made of thermoplastic resin molded on a first sub-assembly comprising an electrically insulating support which supports an electro-resistive track having an incomplete annular shape with two extensions of electrically conductive material linked to a pair of connection terminals and extending outwardly from the casing, and a collector plate having at least one connection terminal extending therefrom;

b) a second subassembly housed in the casing and including a wiper integral with a wiper-holder having notches to facilitate rotation of the second sub-assembly, the first and second sub-assemblies being attached to one another by a tubular shaft of electrically conductive material which thereby establishes electrical contact between the wiper and the collector plate.

The invention also relates to a process for automatically producing miniature potentiometers of the foregoing type comprising:

a) providing a first sub-assembly which comprises a first continuous metallic laminar band, associated to connection terminals, to a collector plate and to an electro-resistive track, on which the casings are molded;

b) providing a second sub-assembly which comprises a second metallic continuous band, including the wipers, on which the wiper-holders are molded;

c) connecting the two sub-assemblies mechanically and and electrically to provide electrical contact between the collector plate and the wiper, wherein this connection is achieved using a third band including connection parts in the form of a metallic tubular shaft.

BRIEF DESCRIPTION OF THE DRAWINGS

The invention will be further illustrated, by way of example, with reference to the accompanying drawings in which.

DETAILED DESCRIPTION OF A PREFERRED EMBODIMENT

Figure 1:
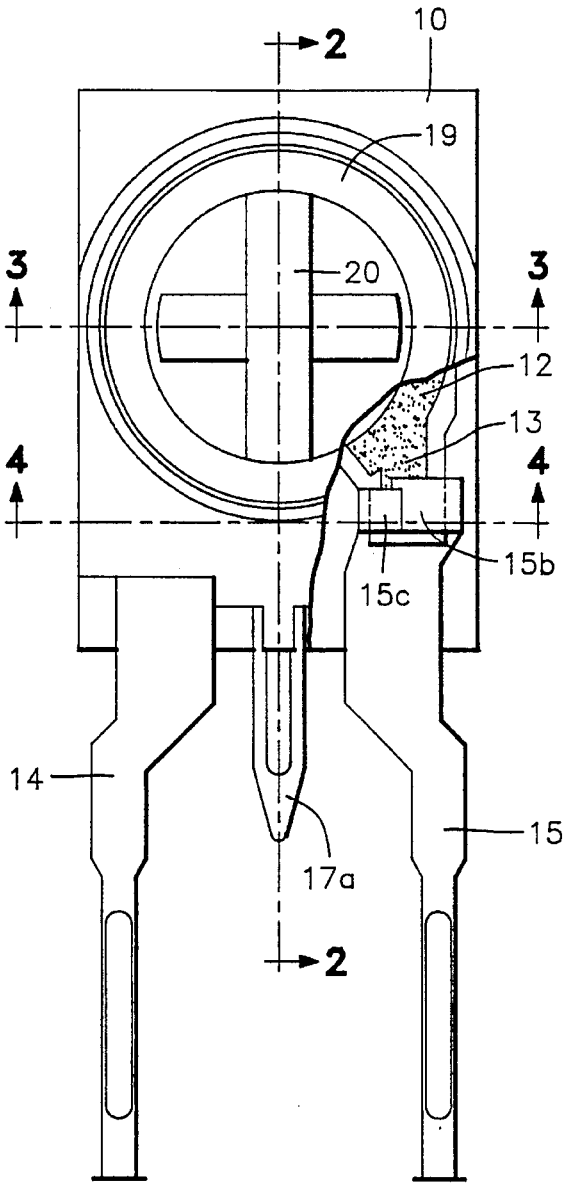
FIG. 1 is a top plan-view of the potentiometer.
Figure 2:
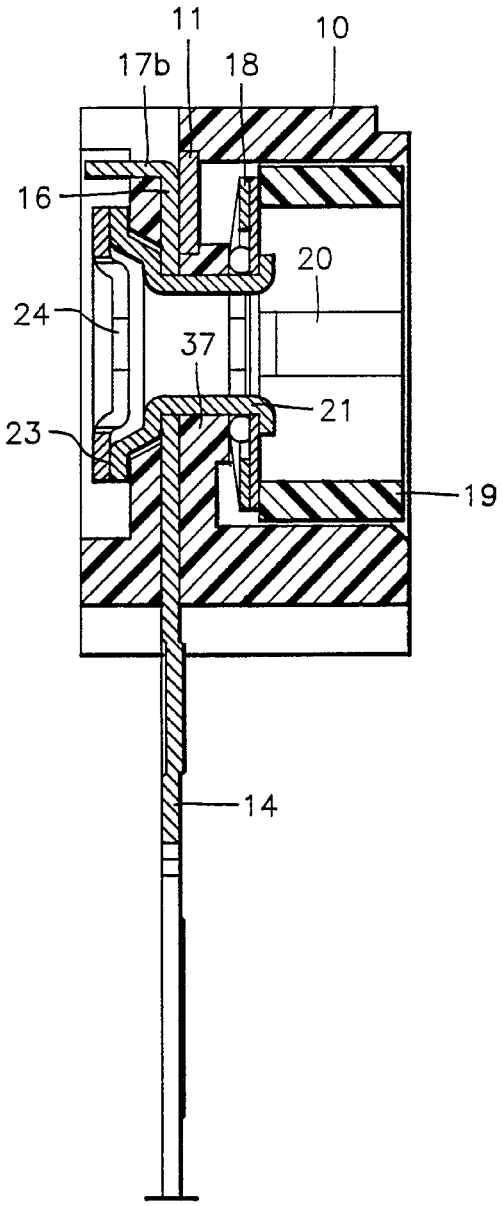
FIG. 2 is a cross sectional view of the potentiometer taken through FIG. 1 along the plane II—II.
Figure 3:
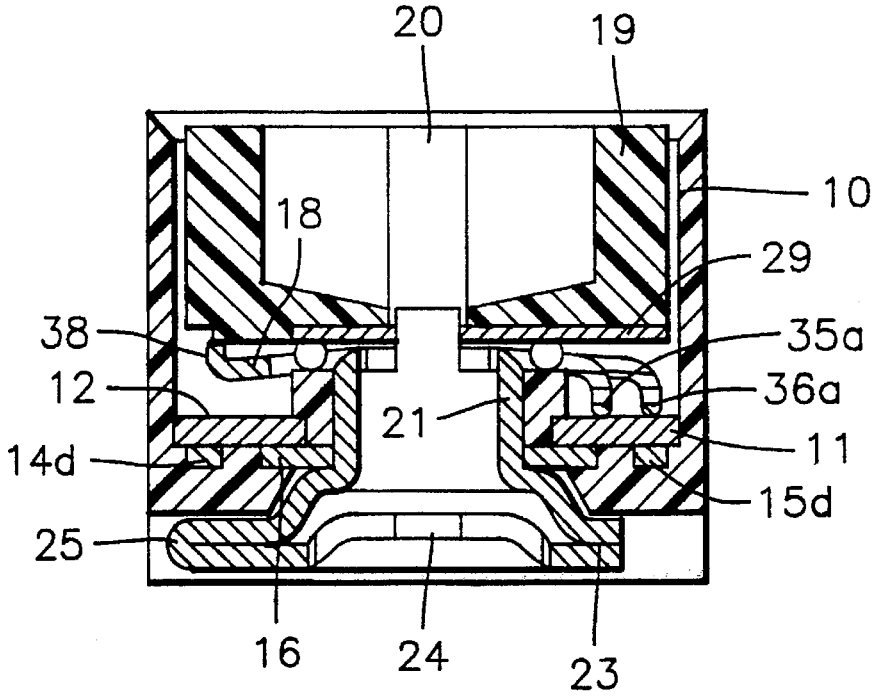
FIG. 3 is a cross sectional view of the potentiometer taken through FIG. 1 along the plane III—III.
Figure 4:
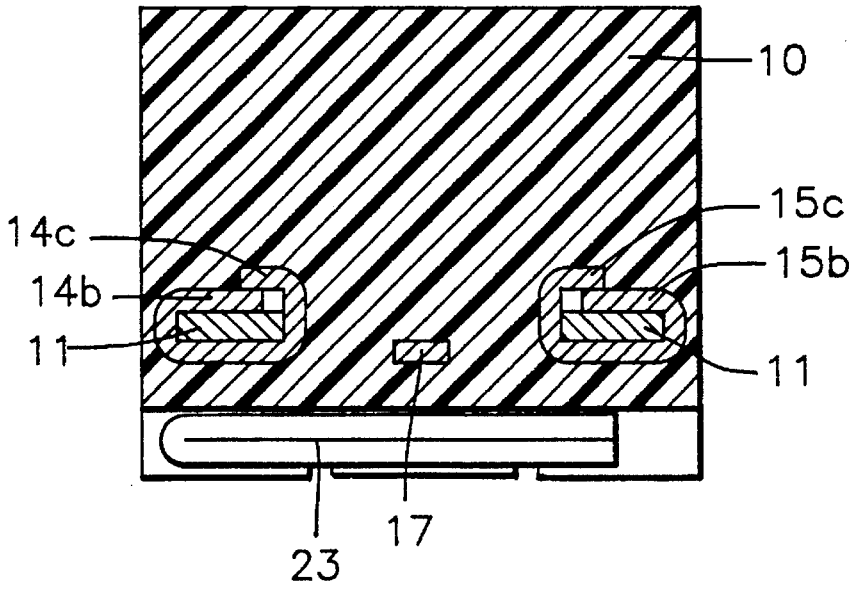
FIG. 4 is a cross sectional view of the potentiometer taken through FIG. 1 along the plane IV—IV.
Figure 5:
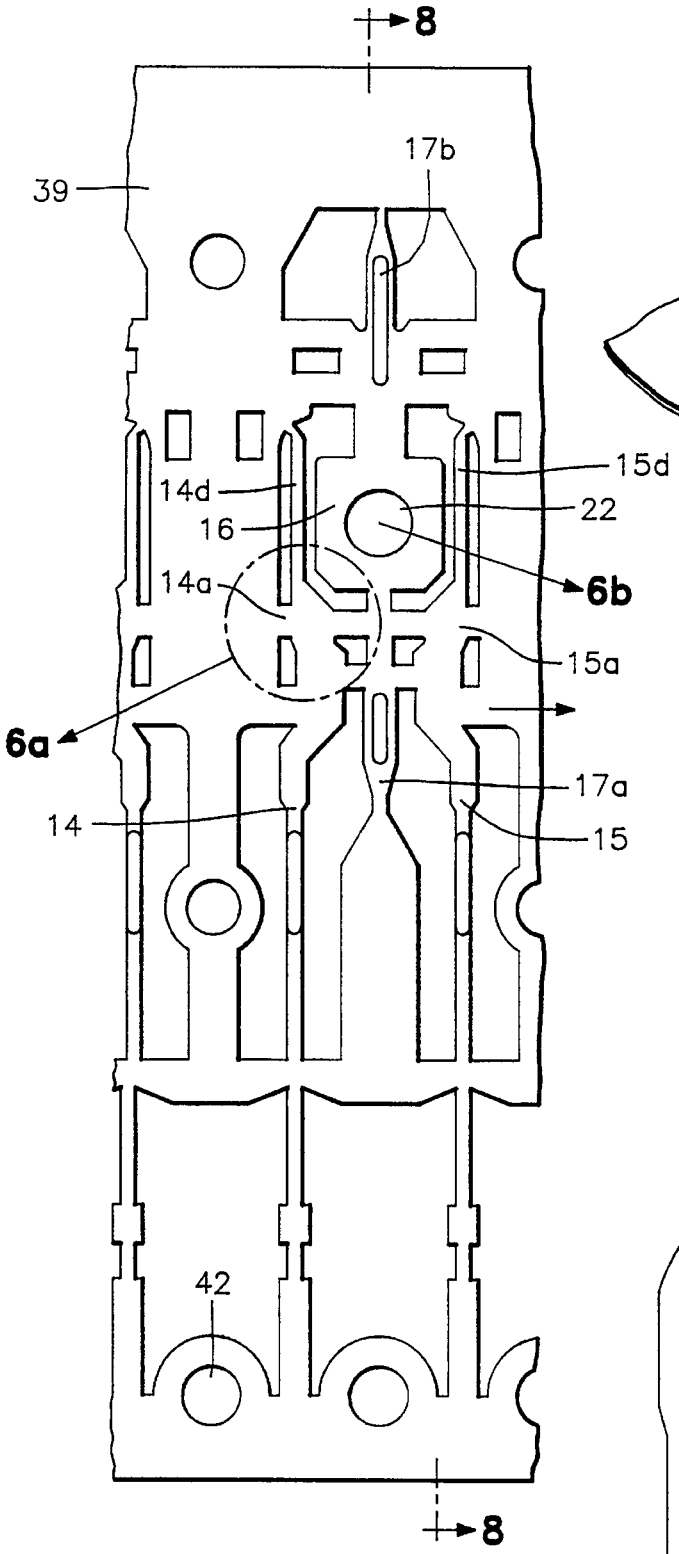
FIG. 5 is a top plan-view of a portion of the connection terminal band and of the collectors.

A preferred embodiment of the present invention will now be described with reference to FIGS. 1–17.

The miniature potentiometer shown in FIGS. 1–17 includes an insulating vessel-shaped casing (10) made of thermoplastic resin molded onto a first sub-assembly. The first sub-assembly comprises an electrically insulating support (11) which supports an electro-resistive track (12). The insulating support (11) and electro-resistive track (12) have a horseshoe-like incomplete annular shape with two extensions (13) of electrically conductive material linked to a pair of connection terminals (14) and (15) extending outwardly from the casing (10). The first subassembly further comprises a collector plate (16) having at least one connection terminal (17) extending therefrom.

The miniature potentiometer further comprises a second sub-assembly housed in the casing (10) and defined by a wiper (18) integral with a wiper-holder (19) having notches (20) to facilitate rotation of the second sub-assembly.

The first and second sub-assemblies are attached to one another by a tubular shaft (21) of electrically conductive material which thereby establishes electrical contact between the wiper (18) and the collector plate (16).

Respective portions (14*a*), (15*a*) of the connection terminals (14), (15) are contained in the body of the casing (10). The casing (10) also contains the collector plate (16) which includes a central hole (22). The collector plate (16) is coplaner with the terminals (14), (15). In addition, the collector plate (16) embodies two oppositely arranged terminals (17*a*) and (17*b*), either one of which can serve as the potentiometer's collector plate terminal. This arrangment, in turn, facilitates use of at least two different potentiometer mounting positions.

The tubular shaft (21) connecting the two sub-assemblies includes a double wall portion (23) located adjacent to the connection between the tubular shaft (21) and the collector plate (16). The double wall portion (23) includes grooves (24) which facilitate rotational driving of the tubular shaft (21). The double wall portion (23) has at least one radial protrusion (25), which constitutes a movable stop for limiting rotation of the tubular shaft (21).

The two terminals (17*a*), (17*b*) of the collector plate (16) extend outwardly from the casing (10) in opposite directions. One of the terminals (17*b*) comprises a 90-degree elbow which extends in a direction parallel to the tubular shaft (21) of the potentiometer. The terminal (17*b*) thus defines a fixed stop which engages the movable stop (25) of the double wall portion (23) in the tubular shaft (21).

The tubular shaft (21) includes a longitudinal end having a larger diameter than the rest of the shaft, thereby defining a mouth (27) at one end of the shaft (21). Extending radially out from the mouth (27), is a narrow strip (26*b*). The narrow strip (26*b*) has a crown-shaped part (26*a*) connected to a distal end of the narrow strip (26*b*). This crown-shaped part (26*a*) includes the grooves (24) which facilitate rotational driving of the shaft (21) and further includes a centrally disposed deepened area (28).

To provide the double wall portion (23), the narrow strip (26*b*) is folded so that the crown-shaped part (26*a*) is substantially concentric with the mouth (27) of the tubular shaft (21). In doing so, the centrally disposed deepened area (28) projects into the mouth (27) of the tubular shaft (21) and the grooves (24) are thus disposed inside the mouth (27) of the shaft (21).

The wiper (18) comprises a first part defined by an annular plate (29) to which the wiper-holder (19) is securely molded and a second part (33) extending radially out from the annular plate (29). The second part (33) has a distal edge and an arcuate groove (34) located proximate the distal edge. The arcuate groove (34) defines two resilient arms (35,36) having centrally located protuberances (35*a*, 36*a*) for frictionally engaging the resistive track (12). The second part (33) is folded 180 degrees against the bottom of the wiper-holder (19) thus defining a blunt fold length (38). The second part (33) further comprises a slight, medially located cross fold (33*a*) in opposite sense to the fold length (38) and defining an open blunt dihedral angle $\alpha$ which is perhaps best illustrated in FIG. 14. Since the cross fold (33*a*) is medially located it is located at a distance from the fold length (38). This, in turn, causes the second part to partially separate from the bottom of the wiper holder (19) and creates a gap at the fold length (38) between the second part (33) and the annular plate (29). The cross fold (33*a*) also causes the distal edge to diverge away from the bottom of the wiper-holder (19) so that the protuberances (35*a*, 36*a*) of the second part (33) are supported on the resistive track (12).

The annular plate (29) of the wiper (18) has several radial, peripheral protuberances (30) adapted to keep the wiper (18) connected to .a strip (40) during a mounting process. The peripheral protuberances (30) are easily shearable by applying a perpendicular stress to the strip (40) thus facilitating separation at the moment the wiper (18) is incorporated into the potentiometer.

The extensions (13) of the electro-resistive track are connected to the terminals (14), (15) using two folded lateral appendages (14*b*, 14*c*, 15*b*, 15*c*) which extend laterally from each connection terminal (14,15). One appendage (14*b*, 15*b*)

from each connection terminal (14,15) is folded so as to make contact with the resistive track (12) while the other appendage (14*c*, 15*c*) of each connection terminal (14,15) is superimposed thereon. The other appendage (14*c*,15*c*) therefore provides retention and thus firmly secures the resistive track (12) to the pair of connection terminals (14,15) before the casing (10) is molded. This is perhaps best illustrated in FIG. 4 and the cut out portion of FIG. 1.

Figure 12:
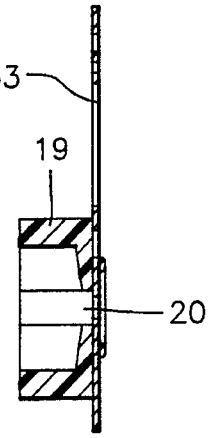
FIG. 12 is a sectional view of the wiper band with a molded wiper-holder.
Figure 13:
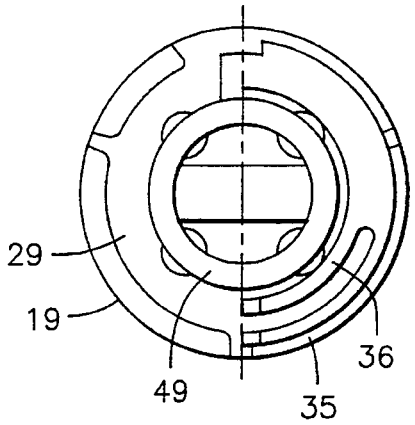
FIG. 13 is a bottom view of the wiper and wiper holder, with half of the wiper member omitted in the left side of the drawing.
Figure 14:
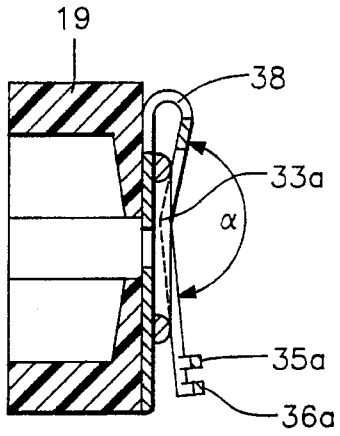
FIG. 14 is a cross sectional view of the wiper after the part which frictionally engages the resistant track has been folded.

As FIGS. 12, 13 and 14 illustrate, the annular plate (29) of the wiper (18) includes a large central opening (31) and through-holes (32) which allow plastic material to flow therethrough to thus firmly secure the wiper (18) to the wiper-holder (19) during a molding operation. In addition, an annular retention rib (49) is provided concentrically with the annular plate (29).

Figure 6A:
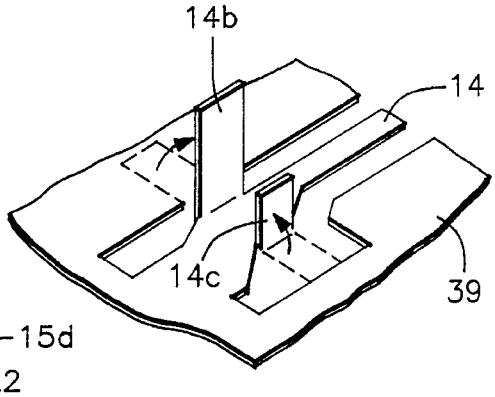
FIG. 6*a* is a perspective partial view and at a larger scale, of the sector VIa of FIG. 5, showing terminal end appendages after a first fold thereof.
Figure 6B:
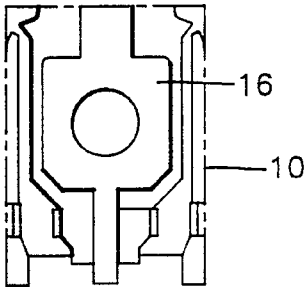
FIG. 6*b* is a partial view, of the area VIb which appears in FIG. 5, showing in thick dotted line the positioning of the casing with respect to the collector plate.
Figure 7:
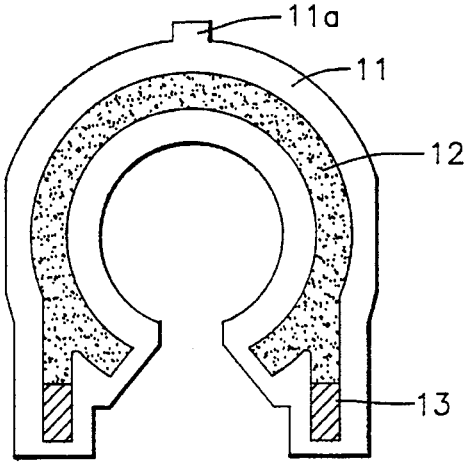
FIG. 7 is a top plan view of the electro-resistant track and its supporting plate.
Figure 8:
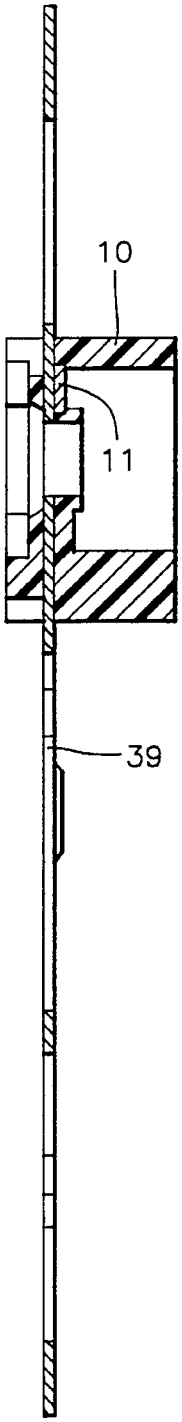
FIG. 8 is a sectional view according to the cut plane VII—VII of FIG. 5, of the collector and terminal band with a casing already molded.
Figure 9:
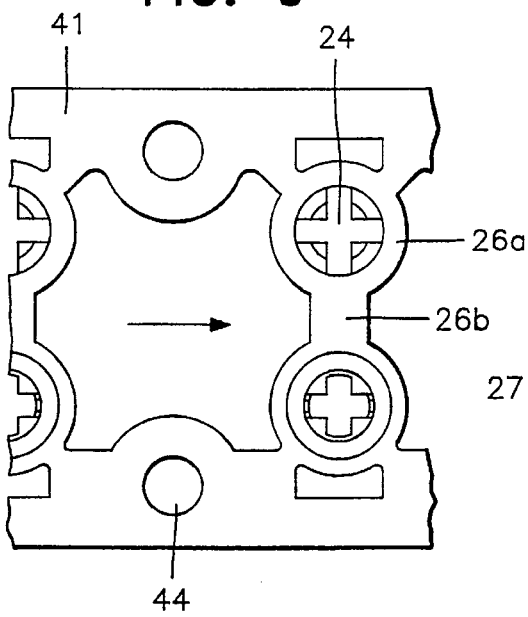
FIG. 9 is a plan-view of a portion of the band holding the connection shafts.
Figure 10:
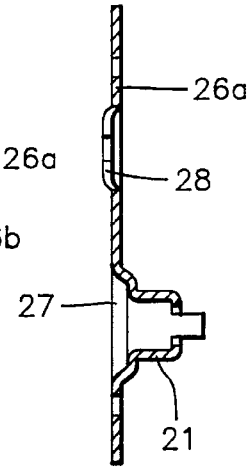
FIG. 10 is a sectional view of the connection shaft band.
Figure 11:
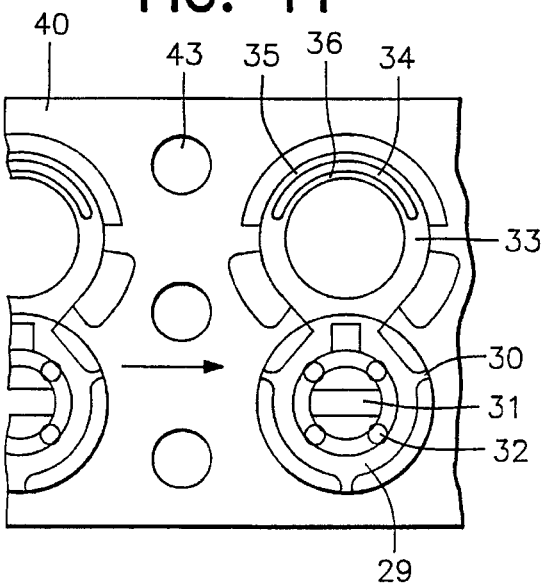
FIG. 11 is a plan-view of a portion of the wiper band.

The location of the casing (10) body with respect to the collector plate (16) is shown in FIG. 6*b* prior to positioning of the electro-resistive track. The position of the appendages of the connection terminal (14), after they have been cut from the band (39) and have sustained a first fold, is shown in FIG. 6*a*. With regard to terminal (15), its appendages sustain an equivalent folding. The appendage (14*b*) is longer to thereby exert a sufficient pressure on the extension (13) of the resistive track (12), while the appendage (14*c*) is shorter to secure the locking of this connection. The appendage (14*b*) can comprise a drawing to best secure the electric contact as disclosed in U.S. Pat. No. 2,958,839.

The support (11) of the resistive track (12) embodies at least an anchoring appendage (11*a*) for its clamping in the molded casing. The ends (13) of the resistive track (12), for example, embody a silver-plated conductor portion.

The bands (39) of the connection terminals and wiper collector plates (40) and (41) of the connection shafts, are hauled and guided by means of holes denoted by reference numerals (42), (43) and (44).

Figure 15:
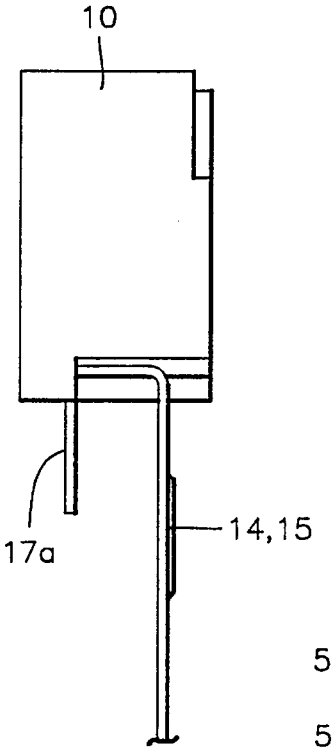
FIG. 15 is a side elevation view showing the horizontal mounting of a potentiometer according to the invention.

The mounting patterns of the horizontal potentiometer and the vertical potentiometer are obtained as follows:

With reference to FIG. 15, in the horizontal potentiometer, terminals (14) and (15) are fold as shown in the figure; the terminal (17*a*) exits directly the collector plate (16) and the terminal (17*b*) has been eliminated during production. Advantageously, this can be done at the step of die cutting shown in FIG. 5.

Figure 16:
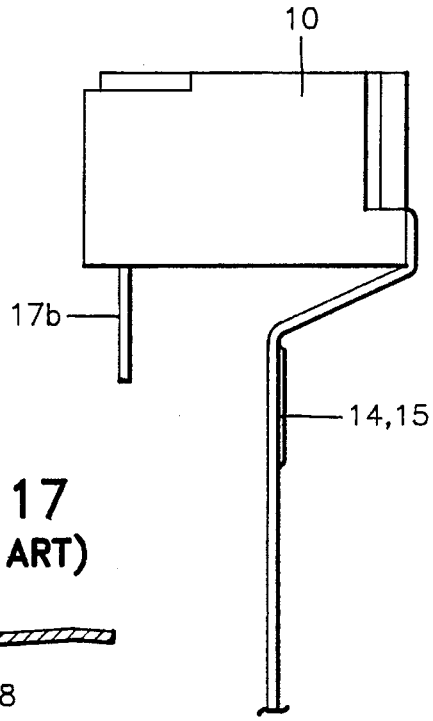
FIG. 16 is a side elevation view showing the vertical mounting of a potentiometer according to the invention.
Figure 17:
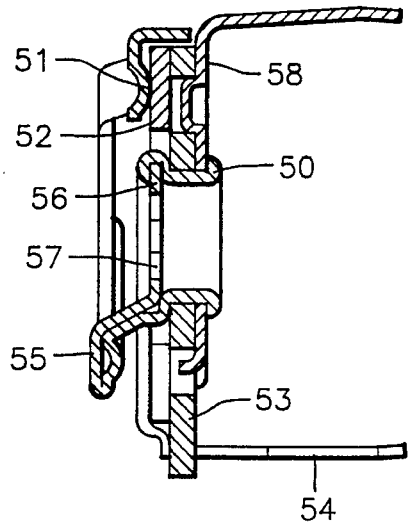
FIG. 17 (PRIOR ART)
FIG. 17 is a cross sectional view showing a potentiometer according to the prior art, namely, Spanish Patent No. 462,232.

With reference to FIG. 16, in the vertical potentiometer, terminals (14) and (15) are folded as shown in the figure, keeping the terminal (17*b*) and eliminating terminal (17*a*) during production.

The potentiometer according to the prior art Spanish Patent No. 462,632 includes a shaft member (50) with a part (51) acting as a wiper and attachment member to an insulating plate (53) of an arcuate resistor (52) linked to a pair of connection terminals (54) and a collector (58)—(58) both supported on the plate (53). The shaft member (50) has an extension (55) with ends in an annular portion (56) with cross grooves (57) folded so that the annular portion (56) concentrically overlaps the bottom of the shaft member (50), the grooves (57) providing a driving engagement for a screwdriver.

A process for producing the potentiometer in accordance with the present invention comprises the following a) an initial shaping of the terminals on a first continuous metallic laminar band (39) hauled by a longitudinal conveying line with step-by-step forward movement, wherein the terminals are initially shaped using dies on which the casing will be molded. Before molding the casing, two pairs of appendages (14*b*, 14*c*) (15*b*, 15*c*) are cut in opposite areas at both sides of a section of the terminals (14, 15) which remains embedded in the casing (10) proximate a side wall thereof. One of the appendages (14*b*) is longer than the other. Both appendages are bent to a fork-shape to accommodate extensions of the resistive track (12). The longer appendage (14*b*) is then folded, under pressure, onto the extensions. Next, the second appendage (14*c*) is folded onto the first appendage (14*b*), thereby locking the appendages in place;

b) a step of coupling two sub-assemblies: a first sub-assembly being fixed (i.e. stationary) including a casing (10), a resistive track (12), a collector plate (16) and terminals (17) (or 17*a* and 17*b*) on the continuous metallic laminar band (39), and the second sub-assembly being movable and including a wiper (18) and a wiper holder (19) on the second band (40). The step of coupling is obtained using the third metallic continuous band (41), and comprises the steps of gradually die cutting the third metallic band to form a tubular shaft (21) having a crown-shaped part (26*a*) connected to a bottom of the shaft (21) by a narrow strip (26*b*), wherein the crown-shaped part is annular and includes cross grooves (24); and producing a fold in approximately the middle of the narrow strip (26*b*) so that the crown-shaped part (26*a*) overlaps concentrically with the bottom of the shaft (21) and a double-walled radial extension is obtained by virtue of two contacting sections of the narrow strip (26*b*).

The process further comprises the steps of attaching the three bands (39, 40, 41) by superpositioning the second and third bands (40) and (41) on opposite sides of the casing (10) and connecting the bands using the tubular shaft (21).

According to the process of the invention the wipers (18) are obtained from the second continuous band (40), using die cutting operations. The wiper-holders are integrally formed by molding an annular plate of the wiper to the bottom of the wiper holder (19), wherein an annular extension (33) of the annular plate terminates in two arcuate arms (35), (36) having centrally located protuberances (35*a*, 36*a*) for frictionally engaging the resistive track ( 12 ) .

The inventive process further comprises the steps of:

folding the annular extension (33) concentrically over the annular plate (29), and providing a slight medial fold (33*a*) in the annular extension (33) so that the two arcuate arms (35, 36) project away from the center of the annular plate, said steps of folding and providing being conducted while the plate (29) and annular extension (33) remain connected to the second band (40).

I claim:

1. A miniature potentiometer including an insulating vessel-shaped casing made of thermoplastic resin molded on a first sub-assembly comprising an electrically insulating support which supports an electro-resistive track having an incomplete annular shape with two extensions of electrically conductive material linked to a pair of connection terminals extending outwardly from said casing, and a collector plate having at least one connection terminal extending therefrom; said potentiometer further comprising a second sub-assembly housed in said casing and defined by a wiper integral with a wiper-holder having notches to facilitate rotation of said second sub-assembly, said first and second sub-assemblies being attached to one another by a tubular shaft of electrically conductive material which thereby establishes electrical contact between said wiper and said collector plate, characterized in that said wiper comprises a first part defined by an annular plate to which said wiper-holder is securely molded and a second part extending in one direction from said annular plate, said second part having a distal edge and an arcuate groove provided proximate said distal edge, said arcuate groove forming two resilient arms having centrally located protuberances for frictionally engaging said resistive track, said second part being folded 180 degrees against the bottom of said wiper-holder thus defining a blunt fold length, said second part further comprising a slight, medially located cross fold in opposite sense to said fold length and at a distance thereof, which causes said second part to partially separate from said bottom of the wiper-holder and creates a gap at the fold length between said second part and said annular plate, said cross fold also causing said distal edge to diverge away from the bottom, said protuberances of said second part being supported on said resistive track.

2. A miniature potentiometer according to claim 1, characterized in that said annular plate of said wiper has several radial, peripheral protuberances adapted to keep said wiper connected to a strip during a mounting process, said peripheral protuberances being easily shearable by applying perpendicular stress to said strip thus facilitating separation at the moment said wiper is incorporated into the potentiometer.

3. A miniature potentiometer according to claim 2, characterized in that said annular plate of said wiper includes a large central opening and through-holes which allow plastic material to flow therethrough to thus firmly secure said wiper to said wiper-holder during a molding operation.

4. A miniature potentiometer according to claim 1, characterized in that said at least one connection terminal of said collector plate comprises two terminals extending outwardly from said casing in opposite directions, and wherein one of said terminals includes a 90-degree elbow extending parallel to said tubular shaft to thereby define a fixed stop which engages a movable stop radially protruding from the bottom of said shaft.

5. A miniature potentiometer according to claim 4 characterized in that said movable stop comprises a double wall portion obtained by folding a narrow strip of a laminar plate connected to the bottom of said tubular shaft against the bottom of said shaft, said narrow strip ending in a crown-shaped part, said crown-shaped part having grooves formed therein.

6. A miniature potentiometer according to claim 1, characterized in that said extensions of said electro-resistive track are connected to said pair of connection terminals using two folded lateral appendages which extend laterally from each connection terminal, one appendage from each connection terminal being in contact with said resistive track while the other appendage of each connection terminal is superimposed thereon to provide retention and to thereby firmly secure said resistive track to said pair of connection terminals before said casing is molded.

* * * * *